US011524390B2

(12) United States Patent
Qian et al.

(10) Patent No.: US 11,524,390 B2
(45) Date of Patent: Dec. 13, 2022

(54) METHODS OF MAKING CHEMICAL MECHANICAL POLISHING LAYERS HAVING IMPROVED UNIFORMITY

(71) Applicants: Rohm and Haas Electronic Materials CMP Holdings, Inc., Newark, DE (US); Dow Global Technologies LLC, Midland, MI (US)

(72) Inventors: Bainian Qian, Newark, DE (US); George C. Jacob, Newark, DE (US); Andrew Wank, Avondale, PA (US); David Shidner, Wilmington, DE (US); Kancharla-Arun K. Reddy, Wilmington, DE (US); Donna Marie Alden, Bear, DE (US); Marty W. DeGroot, Middletown, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 633 days.

(21) Appl. No.: 15/583,037

(22) Filed: May 1, 2017

(65) Prior Publication Data

US 2018/0311792 A1 Nov. 1, 2018

(51) Int. Cl.

| | |
|---|---|
| ***B24D 18/00*** | (2006.01) |
| ***B24D 3/28*** | (2006.01) |
| *B24B 37/24* | (2012.01) |

(52) U.S. Cl.

CPC ..... *B24D 18/0009* (2013.01); *B24D 3/28* (2013.01); *B24B 37/24* (2013.01)

(58) Field of Classification Search

CPC ..... B24D 18/0009; B24D 3/28; B24B 37/24

See application file for complete search history.

(56) References Cited

U.S. PATENT DOCUMENTS

| | | | | |
|---|---|---|---|---|
| 3,615,972 | A | 10/1971 | Morehouse, Jr. et al. | |
| 5,578,362 | A | 11/1996 | Reinhardt et al. | |
| 6,627,671 | B1 * | 9/2003 | Kihara | C08G 18/12 428/313.5 |
| 8,202,334 | B2 | 6/2012 | Alden et al. | |
| 8,257,152 | B2 | 9/2012 | Wank et al. | |
| 8,888,877 | B2 | 11/2014 | Mden et al. | |
| 8,894,732 | B2 | 11/2014 | Wank et al. | |
| 9,073,172 | B2 | 7/2015 | James et al. | |
| 2013/0298473 | A1 * | 11/2013 | Wank | B24B 37/24 51/298 |

* cited by examiner

*Primary Examiner* — Pegah Parvini

(74) *Attorney, Agent, or Firm* — Blake T. Biederman

(57) ABSTRACT

The present invention provides methods of manufacturing a chemical mechanical polishing (CMP polishing) layer for polishing substrates, such as semiconductor wafers comprising providing a composition of a plurality of liquid-filled microelements having a polymeric shell; classifying the composition via centrifugal air classification to remove fines and coarse particles and to produce liquid-filled microelements having a density of 800 to 1500 g/liter; and, forming the CMP polishing layer by (i) converting the classified liquid-filled microelements into gas-filled microelements by heating them, then mixing them with a liquid polymer matrix forming material and casting or molding the resulting mixture to form a polymeric pad matrix, or (ii) combining the classified liquid-filled microelements directly with the liquid polymer matrix forming material, and casting or molding.

6 Claims, 2 Drawing Sheets

METHODS OF MAKING CHEMICAL MECHANICAL POLISHING LAYERS HAVING IMPROVED UNIFORMITY

The present invention relates to methods of making chemical mechanical polishing (CMP polishing) pads having a plurality of microelements, preferably, microspheres, with a polymeric shell dispersed in a polymeric matrix, the methods comprising classifying a composition of the plurality of liquid-filled microelements via centrifugal air classification to remove fines and coarse particles and produce liquid-filled microspheres having a density of 800 to 1500 g/liter or, preferably, from 950 to 1300 g/liter, and then forming CMP polishing pads by any of (i) or (ii):

(i) converting the classified liquid-filled microelements into gas-filled microelements having a density of from 10 to 100 g/liter by heating them to from 70 to 270° C. for a period of from 1 to 30 minutes; and combining the gas-filled microelements with a liquid polymer matrix forming material to form a pad forming mixture, and casting or molding the pad forming mixture to form a polymeric pad matrix; or, (ii) combining the classified liquid-filled microelements with a liquid polymer matrix forming material having a gel time of from 1 to 30 minutes at a casting or molding temperature of from 25 to 125° C. to form a pad forming mixture and casting or molding the pad forming mixture to form a polymeric pad matrix at the casting or molding temperature, and allowing the reaction exotherm to convert the liquid-filled microelements to gas-filled microelements.

Semiconductor wafers having integrated circuits fabricated thereon must be polished to provide an ultra-smooth and flat surface that must vary in a given plane by less than a fraction of a micron. This polishing is usually accomplished in chemical mechanical polishing (CMP polishing). In CMP polishing, a wafer carrier, or polishing head, is mounted on a carrier assembly. The polishing head holds the semiconductor wafer and positions the wafer in contact with a polishing layer of a polishing pad that is mounted on a table or platen within a CMP apparatus. The carrier assembly provides a controllable pressure between the wafer and polishing pad while a polishing medium (e.g., slurry) is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface is polished and made planar by chemical and mechanical action of the polishing layer and polishing medium on the surface.

One problem associated with CMP polishing is wafer scratching caused by impurities and polishing layer inconsistencies in CMP polishing pads. The polishing layers in CMP polishing pads usually comprise microspheres that comprise impurities and have an inconsistent raw material microsphere size distribution within them. Expanding and classifying the microspheres can help improve the consistency of the polishing layer. A centrifugal air classifier has been used in classifying expanded microspheres. However, the classifying of expanded microspheres using a centrifugal air classifier is mainly performed on the basis of inertia; if there is a dense region or impurity in the microspheres, classification is less effective. In manufacturing of the microspheres, inorganic particles, such as colloidal silica and magnesium hydroxide, are used as a stabilizing agent during polymerization. These inorganic particles are the major source for dense regions and impurities in the microspheres. Further, the commercially available polymeric expanded microspheres are made to meet a density specification which does not take impurities into account. Many such impurities result in gouging or scratching of the wafer and can result in chatter marks in metal films such as copper and tungsten and in dielectric materials, such as tetraethyloxysilicate (TEOS) dielectrics. Such damage to the metal and dielectric films can result in wafer defects and lower wafer yield. Still further, the classifying of expanded microspheres does not prevent secondary expansion during curing or casting of polymer materials used to make the CMP polishing pads.

U.S. Pat. No. 8,894,732 B2 to Wank et al. discloses CMP polishing pads having a polishing layer comprising gas-filled polymeric microelements embedded with alkaline earth metal oxides. The polymeric microelements are air classified as gas-filled microelements. The resulting polymeric microelements have a diameter of 5 to 200 μm, have embedded therein less than 0.1 wt. % of alkaline earth metal oxides having a particle size of greater than 5 μm, and are free of agglomerates having an average particle size of greater than 120 μm.

The present inventors have sought to solve the problem of providing methods to more consistently make CMP polishing pads having a polishing layer that has improved uniformity throughout its volume.

STATEMENT OF THE INVENTION

1. In accordance with the present invention, methods of manufacturing a chemical mechanical polishing (CMP polishing) layer, for polishing a substrate selected from at least one of a magnetic substrate, an optical substrate and a semiconductor substrate, comprise: providing a composition of a plurality of liquid-filled microelements, preferably, microspheres, having a polymeric shell; classifying the composition via centrifugal air classification to remove fines and coarse particles and to produce a resulting composition of liquid-filled microelements having a density of 800 to 1500 g/liter or, preferably, from 950 to 1300 g/liter; and forming the CMP polishing layer by any of (i) converting the classified liquid-filled microelements into gas-filled microelements having a density of from 10 to 100 g/liter by heating them to from 70 to 270° C. or, preferably, from 100 to 200° C. for a period of from 1 to 30 minutes; and combining the gas-filled microelements with a liquid polymer matrix forming material to form a pad forming mixture and casting or molding the pad forming mixture to form a polymeric pad matrix; or (ii) combining the classified liquid-filled microelements with a liquid polymer matrix forming material which may have, for example, a gel time of from 1 to 30 minutes or, preferably, from 2 to 10 minutes at a casting or molding temperature of from 25 to 125° C. or, preferably, from 45 to 85° C. to form a pad forming mixture and casting or molding the pad forming mixture to form a polymeric pad matrix at the casting or molding temperature, and allowing the reaction exotherm to convert the liquid-filled microelements to gas-filled microelements.

2. In accordance with the methods of the present invention as in item 1, above, the classifying comprises passing the composition of the plurality of liquid-filled microelements past a Coanda block, whereby the centrifugal air classification operates via a combination of inertia, gas or air flow resistance and the Coanda effect.

3. In accordance with the methods of the present invention as in any one of items 1 or 2, above, wherein the classifying removes from 2 to 20 wt. % or, preferably, from 2 to 12 wt. % of the composition from the composition of the plurality of the liquid-filled microelements, comprising from 1 to 10 wt. % or, preferably, from 1 to 6 wt. % of the composition as fines and from 1 to 10 wt. % or, preferably, from 1 to 6 wt. % of the composition as coarse particles. As used herein, the term "fines" means particles or liquid filled microelements having an average particle size of at least 50% less than the average particle size of the liquid-filled microelements before air classification and purification and "coarse particles" means particles and/or aggregates having an average particle size of at least 50% more than the average particle size of the liquid-filled microelements before air classification and purification.

4. In accordance with the methods of the present invention as in any one of items 1, 2 or 3, above, wherein the resulting composition of liquid-filled microelements is substantially free of silica, magnesia and other alkaline earth metal oxides.

5. In accordance with the methods of the present invention as in any one of items 1, 2, 3 or 4, above wherein the polymeric shell of the liquid-filled microelements comprises polymers chosen from poly(meth)acrylonitrile, poly(vinylidene chloride), poly(methyl methacrylate), poly (isobornyl acrylate), polystyrene, copolymers thereof with each other, copolymers thereof with vinyl halide monomers, such as vinyl chloride, copolymers thereof with $C_1$ to $C_4$ alkyl (meth)acrylates, such as those chosen from ethyl acrylate, butyl acrylate or butyl methacrylate, copolymers thereof with $C_2$ to $C_4$ hydroxyalkyl (meth)acrylates, such as hydroxyethyl methacrylate, or acrylonitrile-methacrylonitrile copolymers.

Unless otherwise indicated, conditions of temperature and pressure are ambient temperature and standard pressure. All ranges recited are inclusive and combinable.

Unless otherwise indicated, any term containing parentheses refers, alternatively, to the whole term as if no parentheses were present and the term without them, and combinations of each alternative. Thus, the term "(poly) isocyanate" refers to isocyanate, polyisocyanate, or mixtures thereof.

All ranges are inclusive and combinable. For example, the term "a range of 50 to 3000 cPs, or 100 or more cPs" would include each of 50 to 100 cPs, 50 to 3000 cPs and 100 to 3000 cPs.

As used herein, unless otherwise indicated, the term "average particle size" or "average particle diameter" means a weight average particle size as determined by a light scattering method using Mastersizer 2000 from Malvern Instruments (Malvern, United Kingdom).

As used herein, the term "ASTM" refers to publications of ASTM International, West Conshohocken, Pa.

As used herein, the term "gel time" means the result obtained by mixing a given reaction mixture at a desired processing temperature, for example, in an VM-2500 vortex lab mixer (StateMix Ltd., Winnipeg, Canada) set at 1000 rpm for 30 s, setting a timer to zero and switching the timer on, pouring the mixture into an aluminum cup, placing the cup into a hot pot of a gel timer (Gardco Hot Pot™ gel timer, Paul N. Gardner Company, Inc., Pompano Beach, Fla.) set at 65° C., stirring the reaction mixture with a wire stirrer at 20 RPM and recording the gel time when the wire stirrer stops moving in the sample.

As used herein, the term "polyisocyanate" means any isocyanate group containing molecule having three or more isocyanate groups, including blocked isocyanate groups.

As used herein, the term "polyisocyanate prepolymer" means any isocyanate group containing molecule that is the reaction product of an excess of a diisocyanate or polyisocyanate with an active hydrogen containing compound containing two or more active hydrogen groups, such as diamines, diols, triols, and polyols.

As used herein, the term "solids" means any material other than water or ammonia that does not volatilize in use conditions, no matter what its physical state. Thus, liquid reactants that do not volatilize in use conditions are considered "solids".

As used herein, the term "substantially free of silica, magnesia and other alkaline earth metal oxides" means that a given composition of microelements comprises less than 1000 ppm or, preferably, less than 500 ppm of all of those materials in free form present in the microspheres, based on the total solids weight of the composition.

As used herein, unless otherwise indicated, the term "viscosity" refers to the viscosity of a given material in neat form (100%) at a given temperature as measured using a rheometer, set at an oscillatory shear rate sweep from 0.1-100 rad/sec in a 50 mm parallel plate geometry with a 100 μm gap.

As used herein, unless otherwise indicated, the term "wt. % NCO" refers to the amount as reported on a spec sheet or MSDS for a given NCO group or blocked NCO group containing product.

As used herein, the term "wt. %" stands for weight percent.

Figure 1:
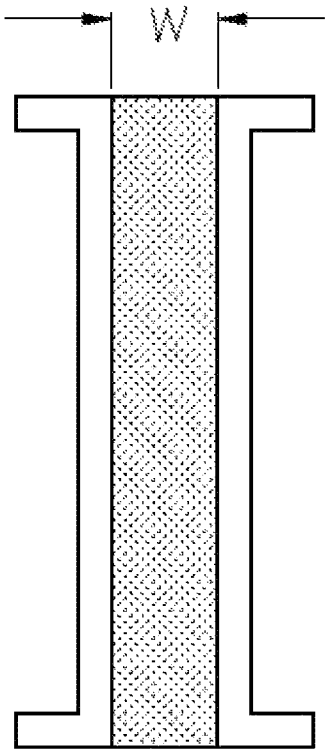
FIG. 1 represents a schematic side-view-cross-section of a Coanda block air classifier.

In accordance with the present invention, chemical mechanical (CMP) polishing pads of the present invention comprise a polishing layer which comprises a homogenous dispersion of microelements in a polymeric pad matrix, such as polyurethane. Homogeneity is important in achieving consistent polishing pad performance. Homogeneity is especially important where a single casting is used to make multiple polishing pads, such as by casting to form a cake of a polymeric matrix dispersion of microelements followed by skiving the cake to a desired thickness to form the CMP polishing pad. The present inventors have found that the methods of classifying a composition of liquid-filled microelements in accordance with the present invention improves their classification, for example, on the basis of inertia because the liquid-filled microelements have more inertia on separation than do gas-filled microelements The polymeric pad matrix of the present invention contains a polishing layer having polymeric microelements distributed within the polymeric pad matrix and at the polishing surface of the polymeric pad matrix. The fluid filling the liquid-filled microelements is, preferably, water, isobutylene, isobutene, isobutane, isopentane, propanol or di(m)ethyl ether, such as distilled water that only contains incidental impurities. After classifying the liquid-filled microelements, the resulting microelements are converted to gas-filled microelements before or during the formation of the polishing layer. The microelements in the CMP polishing pad are polymeric and have an outer polymer surface, enabling them to creating texture at the CMP polishing surface.

The resulting classified and purified liquid-filled polymeric microelements of the present invention have an average particle size of 1 to 100 μm. Preferably, the resulting liquid-filled polymeric microelements typically have an average particle size of 2 to 60 μm. Most preferably, the resulting liquid-filled polymeric microelements typically have an average particle size of 3 to 30 μm. Although not necessary, the polymeric microelements preferably have a spherical shape or represent microspheres. Thus, when the composition of the liquid-filled polymeric microelements comprises spherical liquid-filled microelements, the average size ranges also represent diameter ranges. For example, resulting average particle diameter ranges of 1 to 100 μm, or, preferably, from 2 to 60 μm or, most preferably, from 3 to 30 μm.

Preferably, the plurality of microelements comprise polymeric microspheres with shell walls of either polyacrylonitrile or a polyacrylonitrile copolymer (e.g., Expancel™ beads from Akzo Nobel, Amsterdam, Netherlands).

Air classifying of a composition of liquid-filled microelements improves the classification of such microelements in terms of variable particle size. The classifying of the present invention separates polymeric microelements with various wall thicknesses, particle size and density. This classifying poses multiple challenges; and multiple attempts at centrifugal air classification and particle screening have failed. Those processes are useful for at best removing one disadvantageous ingredient from the feedstock, such as fines. For example, because much of polymeric microspheres have a particle size range overlapping the undesired impurities, it is difficult to separate these using screening methods. It has been discovered, however, that separators comprising a Coanda block operate with a combination of inertia, gas or air flow resistance and the Coanda effect to provide effective results. The Coanda effect states that if a wall is placed on one side of a jet, then that jet will tend to flow along the wall. Specifically, passing liquid-filled microelements in a gas jet adjacent a curved wall of a Coanda block separates the polymeric microelements. The coarse polymeric microelements separate from the curved wall of the Coanda block to clean the polymeric microelements in a two-way separation. When the feed stock includes fines, the process of the present invention may include the additional step of separating the polymeric microelements from the fines using the wall of the Coanda block with the fines following the Coanda block. In a three-way separation, coarse particles separate the greatest distance from the Coanda block, and the middle or cleaned cut separates an intermediate distance and the fines follow the Coanda block.

Suitable classifiers for use in the methods of the present invention include elbow-jet air classifiers sold by The Matsubo Corporation (Tokyo, Japan). In addition to the feedstock jet, the Matsubo separators provide an additional step of directing two additional gas streams into the polymeric microelements to facilitate separating the polymeric microelements from the coarse particles associated with polymeric microelements.

The classifying of particle fines and coarse particles and separation thereof from polymeric microelements having a desirable size distribution advantageously occurs in a single step. Although a single pass is effective for removing both coarse and fine materials, it is possible to repeat the separation through various sequences, such as first coarse pass, second coarse pass, and then first fine pass and second fine pass. Typically, the cleanest polymeric microelement compositions result from two or three-way separations. The disadvantages of additional separation steps are yield and cost.

After classifying the composition of polymeric microelements, the CMP polishing layer is formed by combining the polymeric microelements with a liquid polymer matrix forming material to form a pad forming mixture and casting or molding the pad forming mixture. The typical methods for combining the polymeric microelements and the liquid polymer matrix forming material include static mixing, and mixing in a device comprising impeller or a shear device, such as an extruder or a fluid mixer. Mixing improves the distribution of the polymeric microelements in a liquid polymer matrix. After mixing, drying or curing the polymer matrix forms the polishing pad suitable for grooving, perforating or other polishing pad finishing operations.

Figure 2:
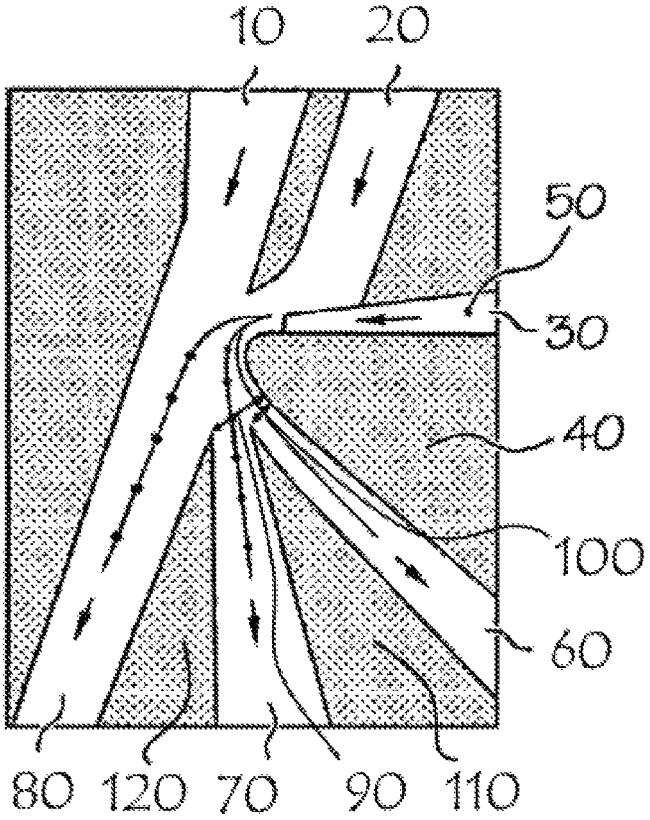
FIG. 2 represents a schematic front-view-cross-section of a Coanda block air classifier.

Referring to FIGS. 1 and 2, the elbow-jet or Coanda block air classifier in FIG. 1 has width (W) between two sidewalls. As shown in FIG. 2, in a Coanda block air classifier, air or other suitable gas, such as carbon dioxide, nitrogen or argon flows through openings (10), (20) and (30) to create a jet-flow around Coanda block (40). Injecting polymeric microelement composition with a feeder (50), such as a pump or vibratory feeder, places the polymeric microelements in a jet stream that initiates the classification process. In the jet stream the forces of inertia, drag (or gas flow resistance) and the Coanda effect combine to classify the particles into three size groupings: fines, medium sized and coarse. The fines (60) follow the Coanda block. The medium sized polymeric particles have sufficient inertia to overcome the Coanda effect for collection as cleaned product (70). Finally, the coarse particles (80) travel the greatest distance for separation from the medium particles. The coarse particles contain a combination of i) denser particles due to presence of any inorganic ingredients and/or solid polymeric microspheres without a liquid-filling and having an average particle size similar to that of the classified (desired) product; and ii) polymeric microelements agglomerated to an average cluster size of 50% greater than the average particle size of the classified product. These coarse particles tend to have negative impacts on wafer polishing and especially patterned wafer polishing for advanced nodes. In operation, the spacing or width of the gaps defining airflow channels through which particles flow determines the fraction separated into each classification. The air flow channel next to the Coanda block has a width (100), corresponding to FΔR or the gap between a wedge, the F wedge (110) and the round Coanda block (40). The medium particles flow into the next nearest airflow channel that lies between the F wedge (110) and the M wedge (120) and has a width (90), corresponding to MΔR or the gap between the M wedge (120) and the round Coanda block. There is a reference point on the round Coanda block for easy measurement of the two gaps. Alternatively, one can shrink the width (100) to zero the fine collector to separate the polymeric microelements into two fractions, a coarse fraction and a cleaned fraction.

In accordance with the present invention, one can widen the width (90) of the airflow channel through which the medium liquid-filled microelements flow to remove less of the microelements from the composition of liquid-filled microelements via classifying them.

In accordance with the present invention, the classified liquid-filled microelements, e.g. liquid-filled polymeric microspheres, can be converted into gas-filled microelements by heating their polymeric shell above its softening point, such as from 70 to 270° C., depending on the type and crosslinking density of the shell polymer. Upon heating, the liquid inside the polymeric shell gasifies, expands the polymeric microspheres, and reduces the density from 800 to 1500 g/liter to 10 to 100 g/liter. The heat needed to convert liquid-filled polymeric microelements into gas-filled polymeric microelements can be provided using IR heating lamps in a separate step or, more conveniently, by the reaction exotherm in forming the CMP polishing layer by molding or casting.

In accordance with the present invention, the microelements are incorporated into the CMP polishing layer at from 0 to 50 vol. % porosity, or, preferably, from 5 to 35 vol. % porosity. To insure homogeneity and good molding results and fill the mold completely, the reaction mixture of the present invention should be well dispersed.

Suitable liquid polymer matrix forming materials include polycarbonate, polysulfone, polyamides, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. The polymer may be in the form of a solution or dispersion or as bulk polymer. Preferably, the polymeric material is a polyurethane in bulk form; and may be either a cross-linked a non-cross-linked polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Preferably, the liquid polymer matrix forming material is a block or segmented copolymer capable of separating into phases rich in one or more blocks or segments of the copolymer. Most preferably, the liquid polymer matrix forming material is a polyurethane. Cast polyurethane matrix materials are particularly suitable for planarizing semiconductor, optical and magnetic substrates. An approach for controlling a pad's CMP polishing properties is to alter its chemical composition. In addition, the choice of raw materials and manufacturing process affects the polymer morphology and the final properties of the material used to make polishing pads.

The liquid polymer matrix forming material can comprise (i) one or more diisocyanate, polyisocyanate or polyisocyanate prepolymer, wherein the prepolymer has a 6 to 15 wt. % NCO content, preferably, an aromatic diisocyanate, polyisocyanate or polyisocyanate prepolymer, such as toluene diisocyanate, and (ii) one or more curative, preferably, an aromatic diamine curative, such as 4,4'-methylenebis(3-chloro-2,6-diethylaniline) (MCDEA).

Preferably, urethane production involves the preparation of an isocyanate-terminated urethane prepolymer made from a polyfunctional aromatic isocyanate and a prepolymer polyol. For purposes of this specification, the term prepolymer polyol includes diols, polyols, polyol-diols, copolymers thereof and mixtures thereof.

Examples of suitable aromatic diisocyanates or polyisocyanates include aromatic diisocyanates, such as, 2,4-toluene diisocyanate, 2,6-toluene diisocyanate, 4,4'-diphenylmethane diisocyanate, naphthalene-1,5-diisocyanate, toluidine diisocyanate, para-phenylene diisocyanate, xylylene diisocyanate and mixtures thereof. Generally, a polyfunctional aromatic isocyanate contains less than 20 wt. % aliphatic isocyanates, such as 4,4'-dicyclohexylmethane diisocyanate, isophorone diisocyanate and cyclohexanediisocyanate, based on the total weight of the total (i). Preferably, the aromatic diisocyanate or polyisocyanate contains less than 15 wt. % aliphatic isocyanates and more preferably, less than 12 wt. % aliphatic isocyanate.

Examples of suitable prepolymer polyols include polyether polyols, such as, poly(oxytetramethylene)glycol, poly(oxypropylene)glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Available examples of PTMEG family polyols are as follows: Terathane™ 2900, 2000, 1800, 1400, 1000, 650 and 250 from Invista, Wichita, Kans.; Polymeg™ 2900, 2000, 1000, 650 from Lyondell Chemicals, Limerick, Pa.; PolyTHF™ 650, 1000, 2000 from BASF Corporation, Florham Park, N.J., and lower molecular weight species such as 1,2-butanediol, 1,3-butanediol, and 1,4-butanediol. Available examples of PPG polyols are as follows: Arcol™ PPG-425, 725, 1000, 1025, 2000, 2025, 3025 and 4000 from Covestro, Pittsburgh, Pa.; Voranol™ 1010L, 2000L, and P400 from Dow, Midland, Mich., Desmophen™ 1110BD or Acclaim™ Polyol 12200, 8200, 6300, 4200, 2200, each from Covestro. Available examples of ester polyols are as follows: Millester™ 1, 11, 2, 23, 132, 231, 272, 4, 5, 510, 51, 7, 8, 9, 10, 16, 253, from Polyurethane Specialties Company, Inc. Lyndhurst, N.J.; Desmophen™ 1700, 1800, 2000, 2001KS, 2001K2, 2500, 2501, 2505, 2601, PE65B from Covestro; Rucoflex™ S-1021-70, S-1043-46, S-1043-55 from Covestro.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 6.0 to 20.0 weight percent. For polyurethanes formed with PTMEG or PTMEG blended with PPG, the preferable weight percent NCO is a range 6 to 13.0; and most preferably it is 8.75 to 12.0.

A suitable polyurethane polymeric material may be formed from a prepolymer reaction product of 4,4'-diphenylmethane diisocyanate (MDI) and polytetramethylene glycol with a diol. Most preferably, the diol is 1,4-butanediol (BDO). Preferably, the prepolymer reaction product has 6 to 13 wt % unreacted NCO.

Typically, a prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine, trimethyleneglycol di-p-aminobenzoate; polytetramethyleneoxide di-p-aminobenzoate, polytetramethyleneoxide mono-p-aminobenzoate; polypropyleneoxide di-p-aminobenzoate; polypropyleneoxide mono-p-aminobenzoate; 1,2-bis(2-aminophenylthio)ethane, 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine.

To increase the reactivity of a polyol with a diisocyanate or polyisocyanate to make a polyisocyanate prepolymer, a catalyst may be used. Suitable catalysts include, for example, oleic acid, azelaic acid, dibutyltindilaurate, 1,8-Diazabicyclo[5.4.0]undec-7-ene (DBU), tertiary amine catalysts, such as Dabco TMR, and mixture of the above.

The components of the polymer used to make the polishing pad are preferably chosen so that the resulting pad morphology is stable and easily reproducible. For example, when mixing 4,4'-methylene-bis-o-chloroaniline (MBCA) with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

Many suitable prepolymers, such as, Adiprene™ LFG740D, LF700D, LF750D, LF751D, and LF753D prepolymers (Chemtura Corporation, Philadelphia, Pa.) are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

A suitable stoichiometric ratio of the sum of the amine ($NH_2$) groups and the hydroxyl (OH) groups in the curative plus any free hydroxyl groups liquid polyurethane matrix forming material to the unreacted isocyanate groups in the liquid polyurethane matrix forming material is from 0.80:1 to 1:20:1, or, preferably 0.85:1 to 1.1:1.

The CMP polishing layer of the CMP polishing pad of the present invention exhibits a density of ≥0.5 g/cm$^3$ as measured according to ASTM D1622-08 (2008). Thus, the polishing layer of the chemical mechanical polishing pad of the present invention exhibits a density of 0.6 to 1.2 g/cm$^3$, or, preferably, 0.7 to 1.1 g/cm$^3$, or, more preferably, 0.75 to 1.0 g/cm$^3$, as measured according to ASTM D1622-08 (2008).

The CMP polishing pad of the present invention exhibits a Shore D hardness (2s) of 30 to 90 as measured according to ASTM D2240-15 (2015), or, preferably, from 35 to 80, or, more preferably 40 to 70.

Preferably, the polishing layer used in the chemical mechanical polishing pad of the present invention has an average thickness of from 500 to 3750 microns (20 to 150 mils), or, more preferably, from 750 to 3150 microns (30 to 125 mils), or, still more preferably, from 1000 to 3000 microns (40 to 120 mils), or, most preferably, from 1250 to 2500 microns (50 to 100 mils).

The polishing layer of the chemical mechanical polishing pad of the present invention has a polishing surface adapted for polishing the substrate. Preferably, the polishing surface has macrotexture selected from at least one of perforations and grooves. Perforations can extend from the polishing surface part way or all the way through the thickness of the polishing layer.

Preferably, grooves are arranged on the polishing surface such that upon rotation of the chemical mechanical polishing pad during polishing, at least one groove sweeps over the surface of the substrate being polished.

Preferably, the polishing surface has macrotexture including at least one groove selected from the group consisting of curved grooves, linear grooves, perforations and combinations thereof.

Preferably, the polishing layer of the chemical mechanical polishing pad of the present invention has a polishing surface adapted for polishing the substrate, wherein the polishing surface has a macrotexture comprising a groove pattern formed therein. Preferably, the groove pattern comprises a plurality of grooves. More preferably, the groove pattern is selected from a groove design, such as one selected from the group consisting of concentric grooves (which may be circular or spiral), curved grooves, cross hatch grooves (e.g., arranged as an X-Y grid across the pad surface), other regular designs (e.g., hexagons, triangles), tire tread type patterns, irregular designs (e.g., fractal patterns), and combinations thereof. More preferably, the groove design is selected from the group consisting of random grooves, concentric grooves, spiral grooves, cross-hatched grooves, X-Y grid grooves, hexagonal grooves, triangular grooves, fractal grooves and combinations thereof. Most preferably, the polishing surface has a spiral groove pattern formed therein. The groove profile is preferably selected from rectangular with straight side walls or the groove cross section may be "V" shaped, "U" shaped, saw-tooth, and combinations thereof.

The chemical mechanical polishing pad of the present invention optionally further comprises at least one additional layer interfaced with the polishing layer. Preferably, the chemical mechanical polishing pad optionally further comprises a compressible sub pad or base layer adhered to the polishing layer. The compressible base layer preferably improves conformance of the polishing layer to the surface of the substrate being polished.

In accordance another aspect of the present invention, the CMP polishing pads can be formed by molding or casting the liquid polymer matrix forming material containing microelements to form a polymeric pad matrix. The forming of the CMP polishing pad can further comprise stacking a sub pad layer, such as a polymer impregnated non-woven, or polymer sheet, onto bottom side of a polishing layer so that the polishing layer forms the top of the polishing pad.

The methods of making a chemical mechanical polishing pad of the present invention may comprise providing a mold; pouring pad forming mixture of the present invention into the mold; and, allowing the combination to react in the mold to form a cured cake; wherein the CMP polishing layer is derived from the cured cake. Preferably, the cured cake is skived to derive multiple polishing layers from a single cured cake. Optionally, the method further comprises heating the cured cake to facilitate the skiving operation. Preferably, the cured cake is heated using infrared heating lamps during the skiving operation in which the cured cake is skived into a plurality of polishing layers.

In accordance with yet another aspect, the present invention provides methods of polishing a substrate, comprising: providing a substrate selected from at least one of a magnetic substrate, an optical substrate and a semiconductor substrate; providing a chemical mechanical (CMP) polishing pad according to the present invention, such as those recited in any one of the methods of forming CMP polishing pads in items 1 to 5, above; creating dynamic contact between a polishing surface of the polishing layer of the CMP polishing pad and the substrate to polish a surface of the substrate; and, conditioning of the polishing surface of the polishing pad with an abrasive conditioner.

In accordance with the methods of making polishing pads in accordance with the present invention, CMP polishing pads can be provided with a groove pattern cut into their polishing surface to promote slurry flow and to remove polishing debris from the pad-wafer interface. Such grooves may be cut into the polishing surface of the polishing pad either using a lathe or by a CNC milling machine.

In accordance with the methods of using the polishing pads of the present invention, the polishing surface of the CMP polishing pads can be conditioned. Pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". Polishing pad conditioning is typically achieved by abrading the polishing surface mechanically with a conditioning disk. The conditioning disk has a rough conditioning surface typically comprised of imbedded diamond points. The conditioning process cuts microscopic furrows into the pad surface, both abrading and plowing the pad material and renewing the polishing texture.

Conditioning the polishing pad comprises bringing a conditioning disk into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated.

The chemical mechanical polishing pad of the present invention can be used for polishing a substrate selected from at least one of a magnetic substrate, an optical substrate and a semiconductor substrate.

Preferably, the method of polishing a substrate of the present invention, comprises: providing a substrate selected from at least one of a magnetic substrate, an optical substrate and a semiconductor substrate (preferably a semiconductor substrate, such as a semiconductor wafer); providing a chemical mechanical polishing pad according to the present invention; creating dynamic contact between a polishing surface of the polishing layer and the substrate to polish a surface of the substrate; and, conditioning of the polishing surface with an abrasive conditioner.

Some embodiments of the present invention will now be described in detail in the following Examples:

An Elbow-Jet Air Classifier model EJ-15-3S with constant feeder system (Matsubo Corporation, Tokyo, Japan) was used to classify a sample of liquid Expancel™ 551 DU 40 isobutane filled microspheres (AkzoNobel, Arnhem, NL). The liquid-filled microspheres had a polymer shell of acrylonitrile and vinylidene chloride copolymer and a measured density of 1127±3 g/liter. The liquid-filled polymeric microspheres were fed through a vibratory feeder into the gas jet with selected settings summarized in Table 1, below. The settings included two wedge positions A and B. Although single pass ($1^{st}$ pass) is effective for removing both disadvantageous fine (F) and coarse (G) ingredients, multiple passes ($2^{nd}$ and $3^{rd}$ pass) can be used to repeat the separation process by passing the classified material (M) through the Elbow-Jet Air Classifier multiple times.

TABLE 1

Settings used in centrifugal air classification of liquid-filled polymeric microspheres

| Example | Feed rate (kg/h) | Ejector air pressure (MPa) | Wedge Position FΔR (mm) | Wedge Position MΔR (mm) | Yield Fine (F) (%) | Yield Classified product (M) (%) | Yield Coarse (G) (%) | Remarks |
|---|---|---|---|---|---|---|---|---|
| 1 | 33.0 | 0.20 | 15.0 | 33.0 | 3.9% | 92.8% | 3.2% | Wedge position A: $1^{st}$ pass |
| 2 | 33.0 | 0.20 | 15.0 | 33.0 | 2.2% | 97.1% | 0.8% | Wedge position A: $2^{nd}$ pass |
| 3 | 33.0 | 0.20 | 15.0 | 33.0 | 1.3% | 98.2% | 0.4% | Wedge position A: $3^{rd}$ pass |
| 4 | 33.0 | 0.20 | 16.0 | 32.0 | 5.7% | 89.9% | 4.4% | Wedge position B: $1^{st}$ pass |
| 5 | 33.0 | 0.20 | 16.0 | 32.0 | 2.3% | 96.3% | 1.3% | Wedge position B: $2^{nd}$ pass |

Scanning electron microscope (SEM images) from the liquid-filled microelements of Example No. 4 (Edge position B: $1^{st}$ pass) of F-cut, M-cut, G-cut, and the raw material used in the test showed that centrifugal air classification is very efficient in removing both big (G-cut) and small (F-cut) particles.

A polyurethane CMP polishing layer was prepared by mixing an isocyanate-terminated urethane prepolymer (Adiprene™ LF750D, 8.9% NCO, from Chemtura Corporation, Philadelphia, Pa.) with 4,4'-methylene-bis-o-chloroaniline (MbOCA) as the curative to form a liquid polymer matrix forming material. Prepolymer and curative temperatures were preheated to 54° C. and 116 C, respectively. The ratio of prepolymer to curative was set such that the stoichiometry, as defined by the percent mole ratio of $NH_2$ groups in the curative to NCO groups in the prepolymer, was 105%. Porosity was introduced into the formulations by adding 2.8 wt. % of liquid-filled polymeric microspheres, based on the total weight of the liquid polymer matrix forming material. The reaction exotherm was used to convert the liquid-filled polymeric microspheres into gas-filled polymeric microspheres.

Prepolymer, curative and microelements were simultaneously mixed together using a vortex mixer. After mixing, the ingredients were dispensed into small cakes of 10 cm in diameter with a thickness approximately 3 cm. The cakes were cured at 104° C. for 16 hours. The cured sample was sliced into thin sheets with a thickness of approximately 0.2 cm. Sample density was measured by its weight over its dimensional volume as well as by a pycnometer. The pycnometer has two chambers, one cell chamber and the one expansion chamber, with known volumes. When the pre-weighed sample material was placed in the cell chamber, the valve to the expansion chamber was closed and the pressure in the cell chamber was set by air at about 34.5 kPa (5 psi).

When the pressure in the cell chamber was equilibrated, the valve to the expansion chamber is opened and a new equilibrium pressure is reached in both the cell and the expansion chamber. Pycnometer volume of the sample can then be calculated using the gas law under these two different conditions.

Open cell content was calculated by the density difference of a foamed sample measured from dimensional volume and pycnometer volume.

$$\text{Open cell content} = \left(1 - \frac{\text{Pycnometer volume}}{\text{Dimensional volume}}\right) \times 100\% = \left(1 - \frac{\text{Dimensional density}}{\text{Pycnometer density}}\right) \times 100\%$$

Table 2, below summarizes sample densities of classified materials from wedge position B, $1^{st}$ pass as well as the raw material. As shown in the open cell content calculations, the F-cut showed the least expansion (with the highest dimensional density) and the M-cut gave the most consistent polishing layer. The G-cut showed the most expansion (with the lowest dimensional density) and a significant amount of open cell content. Thus, the CMP polishing pad made from the Example 4 classified liquid-filled microelements gave improved homogeneity. This is confirmed in Table 2, below.

TABLE 2

Sample densities of classified materials from Wedge position B, $1^{st}$ pass (Example 4)

| Fraction | Dimensional density, g/cm$^3$ | Pycnometer density, g/cm$^3$ | Open cell content |
|---|---|---|---|
| B-F cut | 0.81 | 0.89 | 10% |
| B-G cut* | 0.46 | 1.04 | 56% |
| B-M cut | 0.72 | 0.77 | 6% |
| Raw | 0.65 | 0.73 | 11% |

*Pores are interconnected

When polishing pad layer porosity was examined using scanning electron microscopy (SEM), an unexpected benefit was observed by air classification of the liquid-filled microelements: they did not expand uncontrollably in classifying them. SEM images of the Example 4 liquid-filled polymeric microelement composition showed different cuts (wedge position B, $1^{st}$ pass) as well as the raw material. The raw material, without air classification of the liquid-filled polymeric microspheres showed some abnormal expansion with occasional big blowout holes of about 100 μm. The M-cut, the classified material, showed no abnormal expansion and increased consistency. The G-cut, the coarse material, shows the most abnormal expansion. Thus, the removal of the disadvantageous ingredient of G-cut using air classification may contribute to reduced defects in a CMP pad polishing layer made therewith and improved consistency and uniformity in the polishing layer.

We claim:

1. A method of manufacturing a chemical mechanical polishing (CMP polishing) layer for polishing a substrate selected from at least one of a magnetic substrate, an optical substrate and a semiconductor substrate, comprising:

providing a raw composition of a plurality of liquid-filled microelements having a polymeric shell, the raw composition forming 100 μm blowout holes when casting in polyurethane and a coarse fraction of the new composition forming interconnected pores when casting in polyurethane;

classifying the raw composition via a Coanda block air classifier to remove fines and coarse particles from the raw composition of the plurality of liquid-filled microelements to produce classified liquid-filled microspheres, and the classified liquid-filled microspheres having a density of 800 to 1500 g/liter and an average particle size of 3 to 30 μm and to lower an open cell content in the polishing layer, the open cell content defined as follows:

$$\text{Open cell content} = \left(1 - \frac{\text{Pycnometer volume}}{\text{Dimensional volume}}\right) \times 100\% = \left(1 - \frac{\text{Dimensional density}}{\text{Pycnometer density}}\right) \times 100\%;$$

and, forming the CMP polishing layer by combining the classified liquid-filled microspheres with a liquid polymer matrix forming material having a gel time of from 1 to 30 minutes at a casting or molding temperature of from 25 to 125° C. to form a pad forming mixture and casting or molding the pad forming mixture to form a polymeric pad matrix at the casting or molding temperature, and allowing the reaction exotherm to convert the liquid-filled microspheres to gas-filled microspheres and the gas-filled microelements have a density of 10 to 100 g/liter and the polishing layer is free of 100 μm blowout holes and interconnected pores.

2. The method as claimed in claim 1, wherein the classified liquid-filled microspheres have a density of from 950 to 1300 g/liter.

3. The method as claimed in claim 1, wherein the classifying removes from 2 to 20 wt. % from the raw composition of the plurality of the liquid-filled microspheres, comprising from 1 to 10 wt. % of the composition as fine particles and from 1 to 10 wt. % of the composition as coarse particles.

4. The method as claimed in claim 1, wherein the classifying removes from 2 to 12 wt. % of the composition from the raw composition of the plurality of liquid-filled microspheres, comprising from 1 to 6 wt. % of the composition as fine particles and from 1 to 6 wt. % of the composition as coarse particles.

5. The method as claimed in claim 1, wherein the resulting composition of classified liquid-filled microspheres is substantially free of silica, magnesia and other alkaline earth metal oxides.

6. The method as claimed in claim 1, wherein the polymeric shell of the liquid-filled microspheres comprises polymers chosen from poly(meth)acrylonitrile, poly(vinylidene chloride), poly(methyl methacrylate), poly (isobornyl acrylate), polystyrene, copolymers thereof with each other, copolymers thereof with vinyl halide monomers, copolymers thereof with $C_1$ to $C_4$ alkyl (meth)acrylates, copolymers thereof with $C_2$ to $C_4$ hydroxyalkyl (meth)acrylates, or acrylonitrile-methacrylonitrile copolymers.

* * * * *